US006777866B2

(12) United States Patent
Hong et al.

(10) Patent No.: US 6,777,866 B2
(45) Date of Patent: Aug. 17, 2004

(54) FUNNEL STRUCTURE OF CATHODE RAY TUBE

(75) Inventors: Hyeon-Soo Hong, Kumi (KR); Do-Hoon Kim, Daegu (KR)

(73) Assignee: LG. Philips Displays Korea Co., Ltd., Kyeongsangbuk-Do (KR)

( * ) Notice: Subject to any disclaimer, the term of this patent is extended or adjusted under 35 U.S.C. 154(b) by 0 days.

(21) Appl. No.: 10/315,988

(22) Filed: Dec. 11, 2002

(65) Prior Publication Data

US 2003/0209969 A1 Nov. 13, 2003

(30) Foreign Application Priority Data

May 10, 2002 (KR) ..... 2002-25931

(51) Int. Cl.[7] ..... H01J 31/00; H01J 29/70

(52) U.S. Cl. ..... 313/477 R; 313/440; 313/441; 313/634; 335/210; 335/213

(58) Field of Search ..... 313/477 R, 440, 313/477 HC, 441, 461; 335/210, 213

(56) References Cited

U.S. PATENT DOCUMENTS 6,495,954 B1 * 12/2002 Lee et al. ..... 313/477 R
6,538,369 B1 * 3/2003 Lee et al. ..... 313/440

* cited by examiner

*Primary Examiner*—Nimeshkumar D. Patel
*Assistant Examiner*—Sikha Roy
(74) *Attorney, Agent, or Firm*—Birch, Stewart, Kolasch & Birch, LLP

(57) ABSTRACT

A funnel structure of a CRT in which provided that a deflection angle is 110° or more, a length of an outer surface evaluation line formed by connecting a TOR outer surface end where the funnel yoke portion and the funnel body portion meet and a neck seal outer surface end where the funnel yoke portion and the neck portion meet by a straight line is 'a' and a length of a straight line from the outer surface evaluation line where a vertical distance between the funnel yoke portion outer surface and the outer surface evaluation line is maximized, to the neck seal outer surface end is 'b', a formula of $0.20 \leqq b/a \leqq 0.40$ is satisfied, so that a sensitivity of a deflection yoke is improved and a beam shadow neck margin of the electron beam can be satisfied.

21 Claims, 7 Drawing Sheets

FUNNEL STRUCTURE OF CATHODE RAY TUBE

BACKGROUND OF THE INVENTION

1. Field of the Invention

The present invention relates to a cathode ray tube, and more particularly, to a funnel structure of a cathode ray tube in an optimum funnel horn shape that is capable of improving a sensitivity of a deflection yoke and capable of satisfying a beam shadow neck margin of an electron beam.

2. Description of the Background Art

As shown in FIG. 1, a conventional cathode ray tube includes a fluorescent face 4 is formed with R (red), G (green) and B (blue) fluorescent material coated thereon, a panel 1 formed at a front portion with an explosion-proof unit fixed thereon, a funnel 2 melt at a rear end of the panel 1, an electron gun (no reference numeral given) inserted into a neck portion 13 of the funnel 2 and emitting electron beam 6, a deflection yoke 5 for deflecting the electron beam 6, a shadow mask 3 mounted to have a certain interval with an inner face of the panel 1 and having a plurality of holes for passing the electron beam 6, a main frame 7 and a sub-frame 8 fixedly supporting the shadow mask 3 so that the shadow mask 3 can be maintained with a certain interval with the inner face of the panel 1, a corner spring 9 for connecting and supporting the main frame 7 and the panel 1, an inner shield 10 for shielding the cathode ray tube so that the cathode ray tube can be less influenced by an external earth magnetism, and a reinforcing band 12 installed around the side portion of the panel 1 and preventing an external impact.

A magnet 11 made of 2, 4 and 6 poles is provided to correct a proceeding trajectory of the electron beam so that the electron beam can accurately hit the fluorescent material is provided, by which a color purity defect can be prevented.

A rug 14 is welded at a corner portion of the reinforcing band 12 and coupled with an outer case of a television set or a monitor.

The overall fabrication process of the CRT can be divided into a former process and a latter process. In the former process, step of coating the fluorescent face 4 onto the inner surface of the panel 1, while the latter process includes the following several steps.

First, the fluorescent face 4 is formed, and the panel 1 having a mask assembly in which the shadow mask 3 and the frames 7 and 8 are coupled inserted therein and the funnel 2 having a sealing face with a frit glass coated thereon are sealed at a high temperature through an envelop process. Thereafter, the electron gun is inserted into the inner side of the neck portion 13 of the funnel 2 through an encapsulating process, and the inside of the CRT is vacuumized through an exhausting process and then enclosed.

When the inside of the CRT is vacuumized through these processes, the CRT is compressed or receives a tensile stress according to a shape of the CRT due to an atmosphere pressure.

If a surface area is reduced as a depth of the panel 1 or the funnel 2 becomes considerably small compared to that of the conventional art, the force applied per unit area is increased. Thus, there is shown such a stress distribution that a relatively high stress is concentrated thereto.

As a matter of course, after the exhausting process, the stress concentration occurring at the panel 1 and the funnel 2 can be distributed by attaching the reinforcing band 12 at an outer circumferential surface of the panel 1 so as to make an effect of reducing its absolute value. But such an effect is made little in case of a slim type CRT.

Meanwhile, as shown in FIG. 2, the funnel 2 of a general CRT is divided into a funnel body portion 2*a*, a funnel yoke portion 2*b* where the deflection yoke 5 is positioned, and a neck portion 2*c* where the electron gun is positioned.

A boundary line at which the funnel body portion 2*a* and the funnel yoke portion 2*b* meet is defined as a top of round 21, a boundary line at which the funnel yoke portion 2*b* and the neck portion 2*c* meet is defined as a neck seal line 23, and, a reference line, though not shown with an actual object but always defined in designing, in measuring a depth of the CRT is defined as a reference line 22.

Provided that a region of the screen actually shown is an effective screen and diagonal ends of the four corners of the effective screen are effective surface end 25, when the point at which the tube axis 24 and the reference line 22 intersect is connected to the effective surface end 25, an angle with the tube axis 24 is defined as a deflection angle 26.

The CRT is mainly used for a television set, a computer monitor, or the like, and recently, it is also applied to a high quality product such as an HDTV.

In order for the CRT to be applied to the high quality television or a monitor, or in order to improve a quality itself such as improvement of a brightness of the screen, a deflection frequency of the deflection yoke 5 needs to be heightened. In this respect, however, heightening of the deflection frequency causes problems that a leakage magnetic field is generated due to an increase in a deflection power and a power consumption is increased.

Meanwhile, when the CRT is adopted as a computer monitor, the leakage magnetic field leaked from the product is regulated by a related agency. If a compensation coil is mounted at the deflection yoke 5 in order to reduce the leakage magnetic field, the effect of reducing the leakage magnetic field may be expected to a degree but a power consumption is increased according to the use of the compensation coil which results in an increase in an expense.

And recently, as the CRT is in the trend toward being slim, a distance between the electron gun and the fluorescent material coated at the inner surface of the panel 1 becomes short, and accordingly, as the deflection angle of deflecting the electron beam 6 becomes large, a power consumption of the deflection yoke 5 for controlling the deflection angle is increased.

In an effort to solve the problem, these days, the funnel 2 to which the deflection yoke 5 is mounted has such an outer circumference shape that it is changed from a circular form to an oval form as it goes from the neck portion 2*c* of the funnel 2 toward the panel 1, or an almost rectangular funnel yoke portion 2*b*, not the circular funnel yoke portion 2*b*, is used so that a horizontal or vertical coil of a deflection coil (no reference numeral given) comes near the region where the electron beam 6 formed inside the funnel 2, thereby resultantly reducing power required for the deflection.

However, if the CRT is made slim, even though the rectangular yoke portion is used, the amount of increase in the deflection power is meager compared with the CRT with the existing deflection angle. In addition, due to the structural characteristics of the rectangular shape, the stress concentration is more severe to the diagonal portion of the rectangular yoke portion.

FIG. 3 is a sectional view of the funnel yoke portion 2*b* of the conventional art.

The deflection yoke 5 is attached to the funnel yoke portion 2*b* to control the electron beam 6 emitted from the electron gun to reach the fluorescent material coated at the inner surface of the panel 1. In this respect, if the rectangular yoke portion of the funnel 2 is designed to come closer to the tube axial direction in order to reduce the deflection power, the electron beam 6 collides with the inner surface of the funnel 2, causing a problem of a BSN phenomenon that it is shown black in an actual screen, as shown in FIG. 4.

Moreover, after the CRT is completely fabricated, there needs to be a margin of about 3~4 mm back and forth along the tube axis 24 of the CRT so as for the deflection yoke 5 to be movable for a screen adjustment such as an ITC. If there is no margin between the electron beam 6 and the inside of the funnel 2, the electron beam 6 would easily collide with the inside of the funnel 2.

The position with which the electron beam 6 collides differs depending on the deflection angle as designed in the CRT. If the deflection angle is small, as shown in FIG. 5A, the electron beam collides with the neck seal line 23 of the inner surface 31 of the yoke portion. Meanwhile, if the deflection angle is large, as shown in FIG. 5B, the electron beam collides with the inner surface 31 of the yoke portion at the side of the top of round 21.

The BSN phenomenon occurs according to the margin between the inner surface 31 of the yoke portion 2*b* and the electron beam passing region. If there is no margin, as shown in FIG. 6, a shadow is formed at the end 25 of the effective surface diagonal portion due to the BSN phenomenon.

Therefore, in consideration of the power consumption, preferably, the yoke portion 2*b* of the funnel 2 should be designed to be small so that it can come as close as possible to the electron beam 6. But in the aspect of implementation of an image without the BSN phenomenon, there is a limitation in designing to make the yoke portion 2*b* small.

SUMMARY OF THE INVENTION

Therefore, an object of the present invention is to provide a method for designing an optimum funnel yoke portion that is capable of reducing a deflection power in fabricating a slim type CRT and capable of obtaining a margin between an inner side of a funnel and an electron beam passing region without causing a BSN phenomenon.

To achieve these and other advantages and in accordance with the purpose of the present invention, as embodied and broadly described herein, there is provided a funnel structure of a cathode ray tube having a panel with a fluorescent screen inside thereof, a funnel sealed to the panel in a vacuum state, an electron gun mounted at a neck portion of the funnel and emitting an electron beam toward the fluorescent screen, and a deflection yoke mounted at a yoke portion of the funnel and deflecting the electron beam, wherein provided that a deflection angle is 110° or more, a length of an outer surface evaluation line formed by connecting a TOR outer surface end where the funnel yoke portion and the funnel body portion meet and a neck seal outer surface end where the funnel yoke portion and the neck portion meet by a straight line is 'a' and a length of a straight line from the outer surface evaluation line where a vertical distance between the funnel yoke portion outer surface and the outer surface evaluation line is maximized, to the neck seal outer surface end is 'b', a formula of $0.20 \leqq b/a \leqq 0.40$ is satisfied.

To achieve the above objects, there is also provided a funnel structure of a cathode ray tube having a panel with a fluorescent screen inside thereof, a funnel sealed to the panel in a vacuum state, an electron gun mounted at a neck portion of the funnel and emitting an electron beam toward the fluorescent screen, and a deflection yoke mounted at a yoke portion of the funnel and deflecting the electron beam, wherein provided that a deflection angle is 110° or more, a length of an outer surface evaluation line formed by connecting a TOR outer surface end where the funnel yoke portion and the funnel body portion meet and a neck seal outer surface end where the funnel yoke portion and the neck portion meet by a straight line is 'a', a length of a straight line from the outer surface evaluation line where a vertical distance between the funnel yoke portion outer surface and the outer surface evaluation line is maximized, to the neck seal outer surface end is 'b', a length of a straight line from a point on an outer surface of the funnel yoke portion at which a vertical distance from the outer surface of the funnel yoke portion to the outer surface evaluation line 'a' is maximized to the neck seal end is b1, an included angle between 'b' and 'b1' is 'd', and an angle formed by a tube axis and the outer surface evaluation line is 'c', a formula of $0.22 \leqq d/c \leqq 0.42$ is satisfied.

To achieve the above objects, there is also provided a funnel structure of a cathode ray tube having a panel with a fluorescent screen inside thereof, a funnel sealed to the panel in a vacuum state, an electron gun mounted at a neck portion of the funnel and emitting an electron beam toward the fluorescent screen, and a deflection yoke mounted at a yoke portion of the funnel and deflecting the electron beam, wherein provided that a deflection angle is 110° or more, a length of an inner surface evaluation line formed by connecting a TOR inner surface end where the funnel yoke portion and the funnel body portion meet and a neck seal inner surface end where the funnel yoke portion and the neck portion meet by a straight line is 'a'', a length of a straight line from the inner surface evaluation line where a vertical distance between the funnel yoke portion inner surface and the inner surface evaluation line is maximized, to the neck seal inner surface end is 'b'', a formula of $0.20 \leqq b'/a' \leqq 0.40$ is satisfied.

To achieve the above objects, there is also provided a funnel structure of a cathode ray tube having a panel with a fluorescent screen inside thereof, a funnel sealed to the panel in a vacuum state, an electron gun mounted at a neck portion of the funnel and emitting an electron beam toward the fluorescent screen, and a deflection yoke mounted at a yoke portion of the funnel and deflecting the electron beam, wherein provided that a deflection angle is 110° or more, a length of an inner surface evaluation line formed by connecting a TOR inner surface end where the funnel yoke portion and the funnel body portion meet and a neck seal inner surface end where the funnel yoke portion and the neck portion meet by a straight line is 'a'', a length of a straight line from the inner surface evaluation line where a vertical distance between the funnel yoke portion inner surface and the inner surface evaluation line is maximized, to the neck seal inner surface end is 'b'', a length of a straight line from a point on an inner surface of the funnel yoke portion at which a vertical distance from the inner surface of the funnel yoke portion to the inner surface evaluation line 'a'' is maximized to the neck seal end is b1', a space angle between 'b'' and 'b1'' is 'd'', and an angle formed by a tube axis and the inner surface evaluation line is 'c'', a formula of $0.22 \leqq d'/c' \leqq 0.42$ is satisfied.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Figure 1:
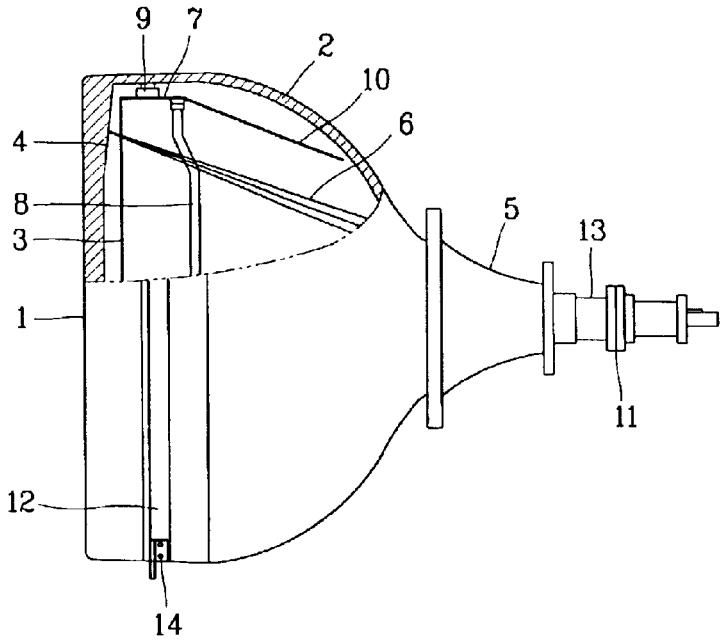
FIG. 1 CONVENTIONAL ART
FIG. 1 is a schematic view of a general CRT.

Reference will now be made in detail to the preferred embodiments of the present invention, examples of which are illustrated in the accompanying drawings.

A funnel structure of a CRT in accordance with the present invention will now be described in detail with reference to the accompanying drawings.

The present invention is directed to an optimum shape design of a funnel yoke portion, allowing a BSN margin so as to restrain a BSN phenomenon caused when an electron beam is deflected at an inner surface of a funnel while maintaining optimum deflection power, in case that CRT is made slim.

The optimization of the funnel structure of the CRT starts from that a straight line connecting an end of an outer surface 32 of a top of round 21 where a funnel yoke portion 2*b* and a funnel body portion 2*a* meet and an end of an outer surface 32 of a neck seal line 23 where the funnel yoke portion 2*b* and a neck portion 2*c* meet is defined as an outer surface evaluation line (OL), a length of the outer surface evaluation line (OL) is defined as 'a', and a distance on the outer surface evaluation line (OL) from the end of the neck seal line 23 to a point where the distance can be the maximum is 'b' when a straight line is drawn to the outer surface evaluation line (OL) from an arbitrary one point of an outer surface 32 of the funnel 2.

The conventional CRTs have the b/a ratio of above 0.41 by models.

In the present invention, however, the ratio between 'a' and 'b', the lengths of the outer surface evaluation lines (OL) of the funnel yoke portion 2*b* for the wide angle product, is designed to satisfy the below formula so that a BSN margin can be obtained and deflection power can be reduced.

$$0.20 \leqq b/a \leqq 0.40 \quad (1)$$

Figure 2:
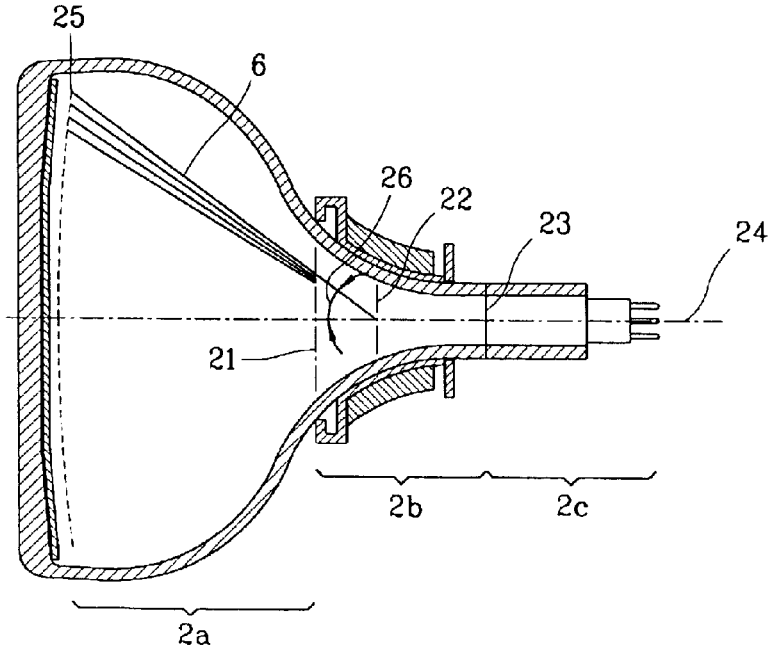
FIG. 2 CONVENTIONAL ART
FIG. 2 is a sectional view showing a top of round, a reference line, a neck seal line and a deflection angle of a funnel of the general CRT.
Figure 3:
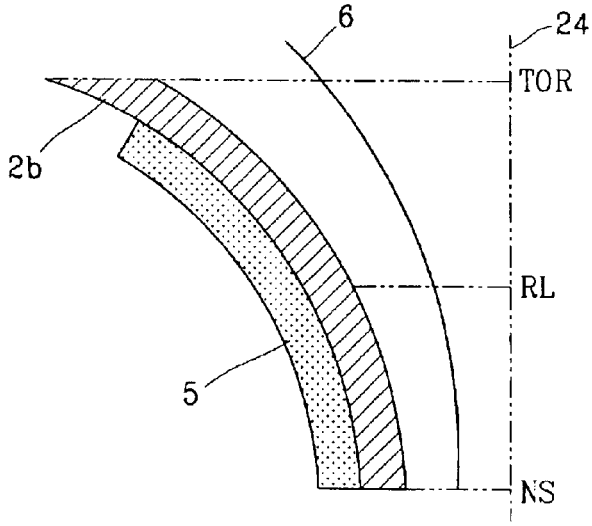
FIG. 3 CONVENTIONAL ART
FIG. 3 is a sectional view of a yoke portion of a general funnel.
Figure 4:
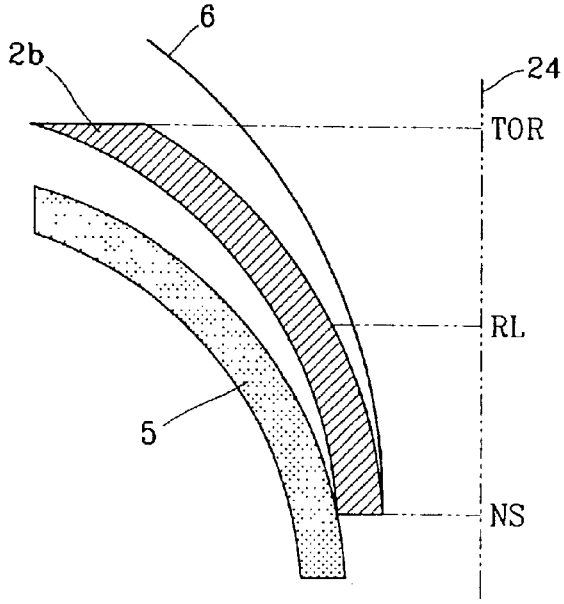
FIG. 4 CONVENTIONAL ART
FIG. 4 is a sectional view showing a state that a BSN phenomenon occurs.
Figure 5A:
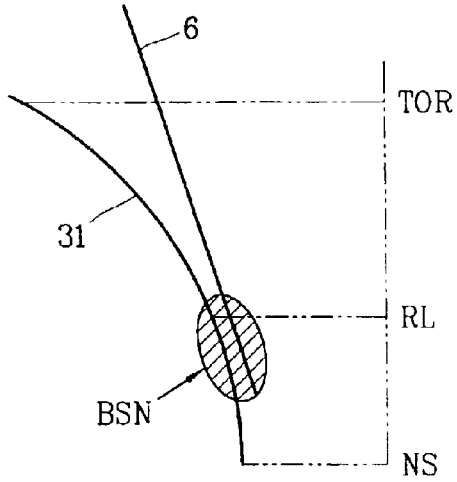
FIG. 5A CONVENTIONAL ART
FIG. 5A is a schematic view showing a position at which an electron beam collides with the inner surface of the yoke portion of the funnel when a deflection angle is small.
Figure 5B:
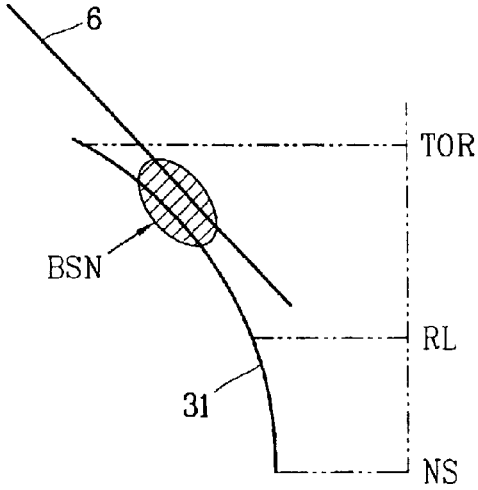
FIG. 5B CONVENTIONAL ART
FIG. 5B a schematic view showing a position at which an electron beam collides with the inner surface of the yoke portion of the funnel when a deflection angle is large.
Figure 6:
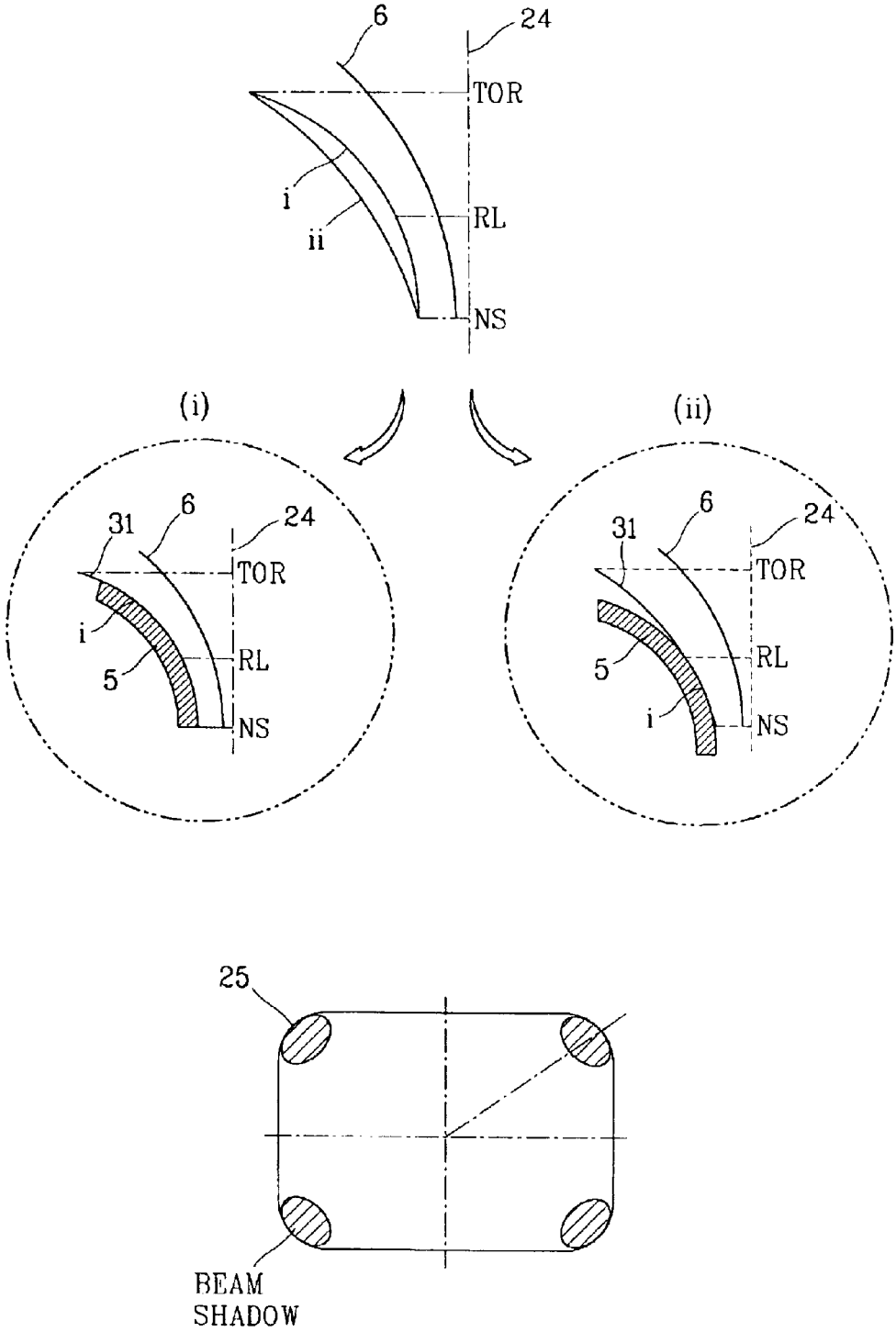
FIG. 6 CONVENTIONAL ART
FIG. 6 is a schematic view showing a path of the electron beam and the BSN phenomenon occurring according to a shape of an inner surface of the yoke portion.
Figure 7:
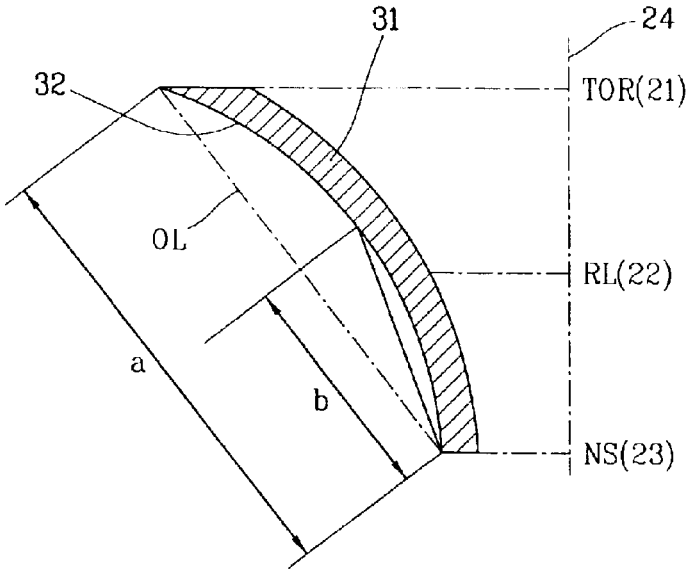
FIG. 7 is schematic sectional view showing a b/a ratio of an outer surface of a yoke portion of a funnel in accordance with the present invention.

In the formula (1), as shown in FIG. 2, referring the value 0.2, after the electron beam 6 is emitted from the electron gun inside the funnel neck portion 2*c*, the electron beam 6 proceeds vertically in the direction of the tube axis 24 toward the panel 1 and starts deflecting leftward or rightward from the deflection center where the tube axis 24 and the reference line 22 meet. Thus, when considering the deflection center of the deflection yoke 5, if the value of the ratio b/a is smaller than 0.20, it is insignificant.

Figure 11:
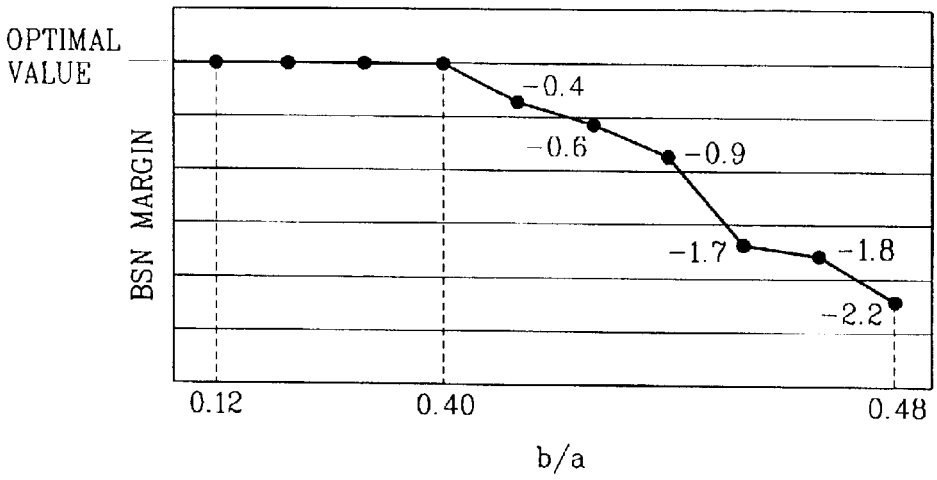
FIG. 11 is a graph showing a BSN margin according to a b/a value of an wide angle product in case that power of a deflection yoke is the same.

FIG. 11 is a graph showing a BSN margin according to the b/a value, the length ratio of the outer surface evaluation line (OL) of the funnel yoke portion 2*b* of the wide angle production with a deflection angle of 110° or more. It is noted that in case of applying the funnel yoke portion 2*b* designed in the ratio of above 0.41 as in the conventional art to the wide angle product with the deflection angle of 110° or more, the BSN margin is absolutely insufficient.

In the case that the BSN margin for the deflection yoke portion 2*b* is short, the position of the deflection yoke 5 is moved to be corrected in the direction of the tube axis 24, so as to adjust an optimal value.

In this respect, however, correction of the position of the deflection yoke 5 can allow the general CRT to obtain the BSN margin but the deflection power is consumed as much. Thus, when the funnel yoke portion 2*b* is designed, the BSN margin and the deflection power should be taken into account together. Especially, in case of a wide angle product with the deflection angle of 110° or more, power should be supplied to the deflection yoke 5 as much, it is important to consider these facts in designing.

TABLE 1

| | | | | | | | | | | |
|---|---|---|---|---|---|---|---|---|---|---|
| Deflection power | ○ | ○ | ◎ | ◎ | ○ | ○ | Δ | X | X | X |
| b/a ratio | 0.28 | 0.30 | 0.32 | 0.35 | 0.38 | 0.40 | 0.42 | 0.44 | 0.46 | 0.48 |

◎: Very Good
○: Good
Δ: Common
X: Bad

As shown in Table 1, in order to reduce the deflection power, it is preferred that the length ratio b/a of the outer surface evaluation line (OL) of the funnel yoke portion 2*b* satisfies the following formula:

$$0.20 \leqq b/a \leqq 0.35 \quad (2)$$

Figure 8:
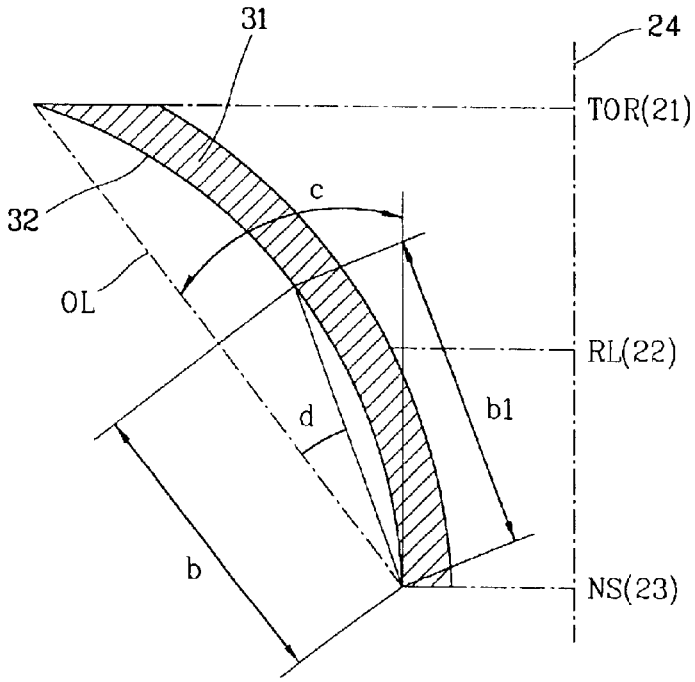
FIG. 8 is a schematic sectional view showing a d/c ratio of an outer surface of the yoke portion of the funnel in accordance with the present invention.

Likewise, as shown in FIG. 8, a straight line connecting an end of an outer surface 32 of a top of round 21 where a funnel yoke portion 2*b* and a funnel body portion 2*a* meet and an end of an outer surface 32 of a neck seal line 23 where funnel yoke portion 2*b* and a neck portion 2*c* meet is defined as an outer surface evaluation line (OL), a length of the outer surface evaluation line (OL) is defined as 'a', a distance on the outer surface evaluation line (OL) from the end of the neck seal line 23 to a point where the distance can be the maximum is 'b' when a straight line is drawn to the outer surface evaluation line (OL) from an arbitrary one point of an outer surface 32 of the funnel 2, a straight line from a point on the outer surface 32 of the funnel yoke portion 2*b* where a vertical distance from the outer surface 32 of the funnel yoke portion 2*b* to the outer surface evaluation line (OL) is maximized to the end of the neck seal line 23 is 'b1', the angle between 'b' and 'b1' is defined as 'd', and an angle formed by the tube axis 24 and the outer surface evaluation line (OL) is defined as 'c'.

Then, like the ratio of b/a, a ratio of d/c can be determined, which becomes a reference to evaluate the shape of the funnel yoke portion 2*b* as to whether the BSN margin is obtained or not when the deflection angle is a wide angle.

Thus, when the ratio of d/c satisfies the following formula, the CRT has the optimum BSN margin.

$$0.22 \leqq d/c \leqq 0.42 \quad (3)$$

Figure 12:
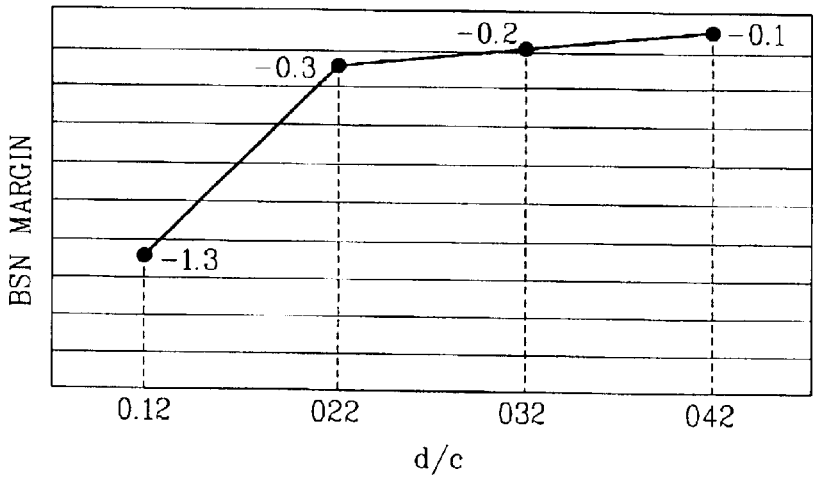
FIG. 12 is a graph showing a BSN margin according to a d/c value of an wide angle product in case that power of a deflection yoke is the same

With reference to FIG. 12, if same power is applied to the deflection yoke 5, a value of the BSN margin according to the d/c ratio of the wide angle product is sharply dropped if the ratio of d/c is smaller than 0.22.

In addition, since the electron beam 6 proceeds vertically in the direction of the tube axis 24 toward the panel 1 and starts deflecting leftward or rightward from the center of the deflection where the tube axis 24 and the reference line 22 meet, a maximum value of the d/c ratio becomes 0.4 when considering the deflection center of the deflection yoke 5. Thus, if a value of the d/c value is greater than 0.42, it becomes insignificant.

Table 2 shows the deflection power level of a wide angle product according to d/c ratios for the optimum BSN margin. As shown in below Table 2, if the d/c ratio is above 0.22, the deflection power is also reduced.

TABLE 2

| Deflection power | X | ○ | ○ | ◎ |
|---|---|---|---|---|
| d/c ratio | 0.12 | 0.22 | 0.32 | 0.42 |

◎: Very Good
○: Good
Δ: Common
X: Bad

Meanwhile, since the electron beam 6 moving in the CRT actually collides with the inner surface 31 of the funnel yoke portion 2*b*, the inner surface 31 of the funnel yoke portion 2*b* should be taken into consideration in its design by applying the concept of the present invention.

That is, the inner and outer surface the funnel 2 of the conventional CRT has such a shape that the thickness is increased as it goes from the neck seal line 23 to the funnel body portion 2*a* in order to smoothly connect the thickness of the funnel body portion 2*a* and the funnel yoke portion 2*b*. Nevertheless, since the shapes are almost the same, with little difference value, the ratio of b/a and d/c of the outer surface 32 of the funnel yoke portion 2*b* of the present invention were obtained the same as that of an experiment result on the inner surface 31 of the funnel yoke portion of the conventional art.

Therefore, the experiment value at the outer surface 32 of the funnel yoke portion 2*b* can be adoptable to the inner surface 31 of the funnel yoke portion 2*b*.

Figure 9:
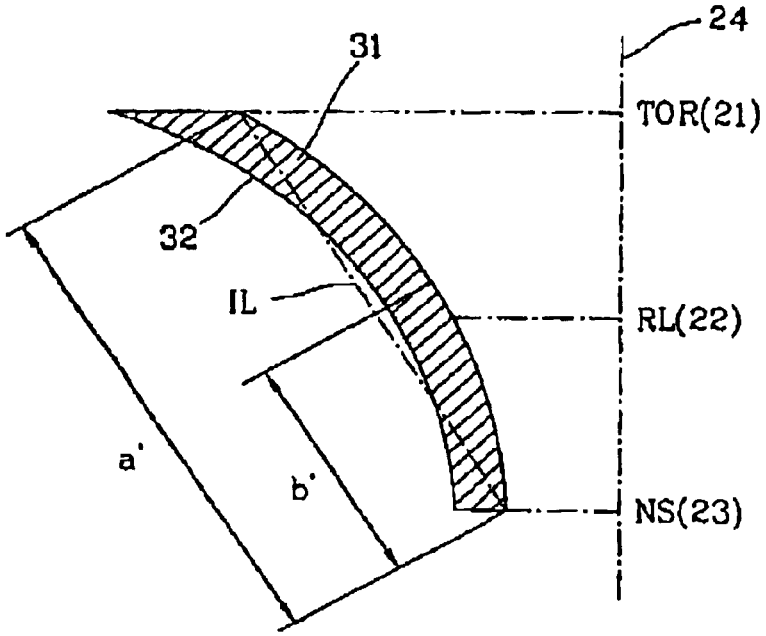
FIG. 9 is a schematic sectional view showing a b'/a' ratio of an inner surface of the yoke portion of the funnel in accordance with the present invention.

That is, as shown in FIG. 9, provided that a straight line connecting an end of an inner surface 31 of a top of round 21 where a funnel yoke portion 2*b* and a funnel body portion 2*a* meet and an end of an inner surface 31 of a neck seal Is line 23 where funnel yoke portion 2*b* and a neck portion 2*c* meet is defined as an inner surface evaluation line (IL), a length of the inner surface evaluation line (IL) is defined as 'a'', a distance on the inner surface evaluation line (IL) from the end of the neck seal line 23 to a point where the distance can be the maximum is 'b'' when a straight line is drawn to the inner surface evaluation line (IL) from an arbitrary one point of the outer surface 32 of the funnel 2, the CRT should satisfy the following formula (4):

$$0.20 \leqq b'/a' \leqq 0.40 \quad (4)$$

Figure 10:
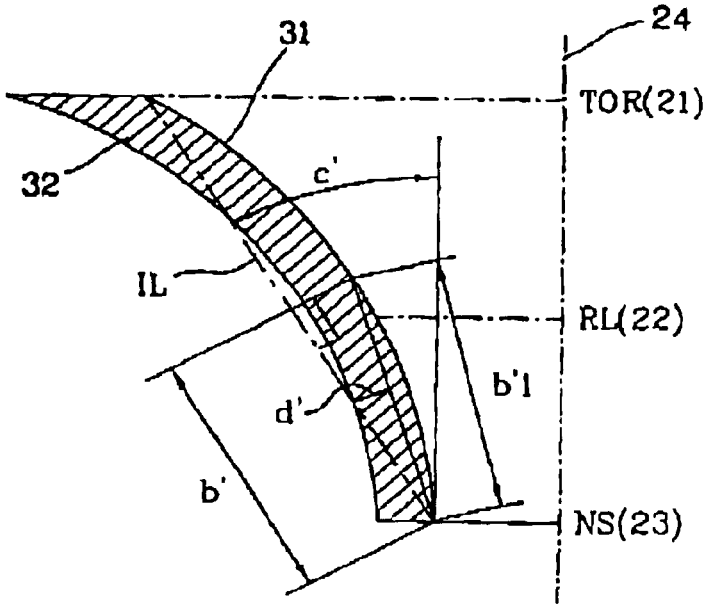
FIG. 10 is a schematic sectional view showing a d'/c' ratio of an inner surface of the yoke portion of the funnel in accordance with the present invention.

In addition, as shown in FIG. 10, provided that a straight line connecting an end of an inner surface 31 of a top of round 21 where a funnel yoke portion 2*b* and a funnel body portion 2*a* meet and an end of an inner surface 31 of a neck seal line 23 where funnel yoke portion 2*b* and a neck portion 2*c* meet is defined as an inner surface evaluation line (IL), a length of the inner surface evaluation line (IL) is defined as 'a'', a distance on the inner surface evaluation line (IL) from the end of the neck seal line 23 to a point where the distance can be the maximum is 'b'' when a straight line is drawn to the inner surface evaluation line (IL) from an arbitrary one point of the inner surface 31 of the funnel 2, a straight line from a point on the inner surface 31 of the funnel yoke portion 2*b* where a vertical distance from the inner surface 31 of the funnel yoke portion 2*b* to the inner surface evaluation line (IL) is maximized to the end of the neck seal line 23 is 'b1'', the angle between 'b'' and 'b1'' is defined as 'd'', and an angle formed by the tube axis 24 and the inner surface evaluation line (IL) is defined as 'c'', the CRT should satisfy the following formula (5):

$$0.22 \leqq d'/c' \leqq 0.42 \quad (5)$$

As so far described, the funnel structure of the CRT of the present invention has the following advantages.

That is, the CRT designed according to the above optimum conditions would reduce a power applied for lots of deflection accompanying in fabricating a slim type CRT. In addition, by obtaining the BSN margin, occurrence of a shadow at the corner portions of the panel can be prevented.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A funnel structure of a cathode ray tube having a panel with a fluorescent screen inside thereof, a funnel sealed to the panel in a vacuum state, an electron gun mounted at a neck portion of the funnel and emitting an electron beam toward the fluorescent screen, and a deflection yoke mounted at a yoke portion of the funnel and deflecting the electron beam, wherein provided that a length of an outer surface evaluation line formed by connecting a TOR outer surface end where the funnel yoke portion and the funnel body portion meet and a neck seal outer surface end where the funnel yoke portion and the neck portion meet by a straight line is 'a' and a length of a straight line from the outer surface evaluation line where a vertical distance between the funnel yoke portion outer surface and the outer surface evaluation line is maximized, to the neck seal outer surface end is 'b', the following formula is satisfied:

$$0.20 \leqq b/a \leqq 0.40.$$

2. The structure of claim 1, wherein the relation between 'a'and 'b' satisfies the following formula:

$$0.20 \leqq b/a \leqq 0.35.$$

3. The structure of claim 1, wherein a straight line from a point on the outer surface of the funnel yoke portion where a vertical distance front the outer surface of the funnel yoke portion to the outer surface evaluation line is maximized to the end of the neck seal line is 'b1', the angle between 'b' and 'b1' defined as 'd', and an angle formed by the tube axis and the outer surface evaluation line is defined as 'c', the following formula is satisfied:

$$0.22 \leqq d/c0.42.$$

4. The structure of claim 1, wherein the CRT has a deflection angle 110° or more.

5. The structure of claim 1, wherein the funnel yoke portion is formed such that it is formed almost in a rectangular shape as it goes from the neck portion side of the tunnel toward the panel.

6. A funnel structure of a cathode ray tube having a panel with a fluorescent screen inside thereof, a funnel sealed to the panel in a vacuum state, an electron gun mounted at a neck portion of the funnel and emitting an electron beam toward the fluorescent screen, and a deflection yoke mounted at a yoke portion of the funnel and deflecting the electron beam, wherein provided that a length of an outer surface evaluation line formed by connecting a TOR outer surface end where the funnel yoke portion and the funnel body portion meet and a neck seal Outer surface end where the funnel yoke portion and the neck portion meet by a straight line is 'a', a length of a straight line from the outer surface evaluation line where a vertical distance between the funnel yoke portion outer surface and the outer surface evaluation line is maximized, to the neck seal outer surface end is 'b', a length of a straight line from a point on an outer surface of the funnel yoke portion at which a vertical distance from the outer surface of the funnel yoke portion to the outer surface evaluation line 'a' is maximized to the neck seal end is b1, a space angle between 'b' and 'b1' is 'd', and an angle formed by a tube axis and the outer surface evaluation line is 'c', the following formula is satisfied:

$$0.22 \leqq d/c \leqq 0.42.$$

7. The structure of claim 6, wherein the CRT has a deflection angle 110° or more.

8. The structure of claim 6, wherein the funnel yoke portion is formed such that it is formed almost in a rectangular shape as it goes from the neck portion side of the funnel toward the panel.

9. A funnel structure of a cathode ray tube having a panel with a fluorescent screen inside thereof, a funnel sealed to the panel in a vacuum state, an electron gun mounted at a neck portion of the funnel and emitting an electron beam toward the fluorescent screen, and a deflection yoke mounted at a yoke portion of the funnel and deflecting the electron beam, wherein provided that a length of an inner surface evaluation line formed by connecting a TOR inner surface end where the funnel yoke portion and the funnel body portion meet and a neck seal inner surface end where the funnel yoke portion and the neck portion meet by a straight line is 'a'', a length of a straight line from the inner surface evaluation line where a vertical distance between the funnel yoke portion inner surface and the inner surface evaluation line is maximized, to the neck seal inner surface end is 'b'', the following formula is satisfied:

$$0.20 \leqq b'/a' \leqq 0.40.$$

10. The structure of claim 9, wherein the relation between 'a'' and 'b'' satisfies the following formula:

$$0.20 \leqq b'/a' \leqq 0.35.$$

11. The structure of claim 9, wherein a straight line from a point on the inner surface of the funnel yoke portion where a vertical distance from the inner surface of the funnel yoke portion to the inner surface evaluation line is maximized to the end of the neck seal line is 'b1'', the angle between 'b'' and 'b1'' is defined as 'd'', and an angle formed by the tube axis and the inner surface evaluation line is defined as 'c'', the following formula is satisfied:

$$0.22 \leqq d'/c' \leqq 0.42.$$

12. The structure of claim 9, wherein the CRT has a deflection angle 110° or more.

13. The structure of claim 9, wherein the funnel yoke portion is formed such that it is formed almost in a rectangular shape as it goes from the neck portion side of the funnel toward the panel.

14. A funnel structure of a cathode ray tube having a panel with a fluorescent screen inside thereof, a funnel sealed to the panel in a vacuum state, an electron gun mounted at a neck portion of the funnel and emitting an electron beam toward the fluorescent screen, and a deflection yoke mounted at a yoke portion of the tunnel and deflecting the electron beam, wherein provided that a length of an inner surface evaluation line formed by connecting a TOR inner surface end where the funnel yoke portion and the funnel body portion meet and a neck seal inner surface end where the funnel yoke portion and the neck portion meet by a straight line is 'a'', a length of a straight line from the inner surface evaluation line where a vertical distance between the funnel yoke portion inner surface and the inner surface evaluation line is maximized, to the neck seal inner surface end is 'b'', a length of a straight line from a point on an inner surface of the funnel yoke portion at which a vertical distance from the inner surface of the funnel yoke portion to the inner surface evaluation line 'a'' is maximized to the neck seal end is b1', a space angle between 'b'' and 'b1'' is 'd'', and an angle formed by a tube axis and the inner surface evaluation line is 'c'', the following formula is satisfied:

$$0.22 \leqq d'/c' \leqq 0.42.$$

15. The structure of claim 14, wherein the relation between 'a'' and 'b'' satisfies the following formula:

$$0.20 \leqq b'/a' \leqq 0.35.$$

16. The structure of claim 14, wherein the CRT has a deflection angle 110° or more.

17. The structure of claim 14, wherein the funnel yoke portion is formed such that it is formed almost in a rectangular shape as it goes from the neck portion side of the funnel toward the panel.

18. A funnel structure of a cathode ray tube having a panel with a fluorescent screen inside thereof, a funnel sealed to the panel in a vacuum state, an electron gun mounted at a neck portion of the funnel and emitting an electron beam toward the fluorescent screen, and a deflection yoke mounted at a yoke portion of the funnel and deflecting the electron beam, wherein provided that a deflection angle is 110° or more, a length of an outer surface evaluation line formed by connecting a TOR outer surface end where the funnel yoke portion and the funnel body portion meet and a neck seal outer surface end where the funnel yoke portion and the neck portion meet by a straight line is 'a', a length of a straight line from the outer surface evaluation line where a vertical distance between the funnel yoke portion outer surface and the outer surface evaluation line is maximized, to the neck seal outer surface end is 'b', a length of a straight line from a point on an outer surface of the funnel yoke portion at which a vertical distance from the outer surface of the funnel yoke portion to the outer surface evaluation line 'a' is maximized to the neck seal end is b1, a space angle between 'b' and 'b1' is 'd', and an angle formed by a tube axis and the outer surface evaluation line is 'c', the following formulas are satisfied:

$$0.20 \leqq b/a \leqq 0.40 \text{ and } 0.22 \leqq d/c \leqq 0.42, \text{ and}$$

the funnel yoke portion is formed such that it is formed almost in a rectangular shape as it goes from the neck portion side of the funnel toward the panel.

19. The structure of claim 18, wherein the relation between 'a' and 'b' satisfies the following formula:

$$0.20 \leqq b/a \leqq 0.35.$$

20. A funnel structure of a cathode ray tube having a panel with a fluorescent screen inside thereof, a funnel sealed to the panel in a vacuum state, an electron gun mounted at a neck portion of the funnel and emitting an electron beam toward the fluorescent screen, and a deflection yoke mounted at a yoke portion of the funnel and deflecting the electron beam, wherein provided that a deflection angle is 110° or more, a length of an inner surface evaluation line formed by connecting a TOR inner surface end where the funnel yoke portion and the funnel body portion meet and a neck seal inner surface end where the funnel yoke portion and the neck portion meet by a straight line is 'a'', a length of a straight line from the inner surface evaluation line where a vertical distance between the funnel yoke portion inner surface and the inner surface evaluation line is maximized, to the neck seal inner surface end is 'b'', a length of a straight line from a point on an inner surface of the funnel yoke portion where a vertical distance from the inner surface of the funnel yoke portion to the inner surface evaluation line 'a'' is maximized to the neck seal end is b1', a space angle between 'b'' and 'b1'' is 'd'', and an angle formed by a tube axis and the inner surface evaluation line is 'c'', the following formulas are satisfied:

$$0.20 \leqq b'/a' 0.40 \text{ and } 0.22 \leqq d'/c' \leqq 0.42, \text{ and}$$

the funnel yoke portion is formed such that it is formed almost in a rectangular shape as it goes from the neck portion side of the funnel toward the panel.

21. The structure of claim 20, wherein the relation between 'a'' and 'b'' satisfies the following formula:

$$0.20 \leqq b'/a' \leqq 0.35.$$

* * * * *